US011338575B2

(12) United States Patent
Schneider et al.

(10) Patent No.: US 11,338,575 B2
(45) Date of Patent: May 24, 2022

(54) METHOD AND CONTROLLER FOR PREDICTING AND COMPENSATING FOR A NOZZLE FAILURE

(71) Applicant: Canon Production Printing Holding B.V., Venlo (NL)

(72) Inventors: Claus Schneider, Eching (DE); Ulrich Stoeckle, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 17/065,990

(22) Filed: Oct. 8, 2020

(65) Prior Publication Data

US 2021/0107278 A1 Apr. 15, 2021

(30) Foreign Application Priority Data

Oct. 10, 2019 (DE) ..... 102019127279.3

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586
See application file for complete search history.

(56) References Cited

U.S. PATENT DOCUMENTS 10,596,806 B2 * 3/2020 Neeb ..... B41J 2/0451
2012/0250040 A1 10/2012 Yamazaki
2017/0120647 A1 5/2017 Kyoso

FOREIGN PATENT DOCUMENTS

DE 102018217124 A1 5/2019

OTHER PUBLICATIONS

German action dated May 15, 2020, Application No. 10 2019 127 279.3.

* cited by examiner

*Primary Examiner* — Thinh H Nguyen
(74) *Attorney, Agent, or Firm* — The Webb Law Firm

(57) ABSTRACT

A controller for an inkjet printing device is configured to predict a remaining time period until a failure of the nozzle on the basis of a time curve of offset measurement values with regard to the offset of the ink droplets ejected by said nozzle. A compensation measure may be introduced promptly, before the actual failure of the nozzle on the basis of the prediction in order to have the effect that the compensation measure takes effect at latest at the point in time of the failure of the nozzle, and thus an interruption of the print quality may be prevented.

15 Claims, 2 Drawing Sheets

METHOD AND CONTROLLER FOR PREDICTING AND COMPENSATING FOR A NOZZLE FAILURE

CROSS REFERENCE TO RELATED APPLICATIONS

This patent application claims priority to German Patent Application No. 102019127279.3, filed Oct. 10, 2019, which is incorporated herein by reference in its entirety.

BACKGROUND

Field

The disclosure relates to a method and a corresponding processing unit that enable a nozzle failure to be predicted and be carefully at least partially compensated as needed.

Related Art

A printing device, in particular an inkjet printing device, for printing to a recording medium has one or more print heads with respectively one or more nozzles. The nozzles are respectively configured to eject ink droplets in order to print dots of a print image onto the recording medium. The one or more print heads and the recording medium are thereby moved relative to one another in order to ink dots at different positions, in particular in different lines, on the recording medium, and in order to thus print a print image on the recording medium.

A degradation of the positioning accuracy of the ink droplets ejected from a nozzle may occur over time due to various external and internal influences. Due to effects of aging, wear, air bubble formation, and/or drying of ink, it may occur that the force of the actuator of a nozzle is no longer sufficient to position the droplets with the required speed and accuracy on the recording medium. This state may grow increasingly worse and may thus possibly lead to a failure of the nozzle.

To determine the positioning accuracy of the nozzles of a print head, the printing device may be induced to print a special line pattern on the recording medium. On the basis of the line pattern on the recording medium, it may then be checked whether the line printed by a nozzle is absent or exhibits a relatively high position offset. Based on this, a decision may then be made as to whether a nozzle failure is present or not. Furthermore, one or more compensation measures may be introduced in order to at least partially compensate the detected nozzle failure.

The detection of a nozzle failure and the subsequent introduction of a compensation measure leads to the situation that the print quality of the printing device is negatively affected at least temporarily up to the point in time as of which the compensation measure takes effect.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
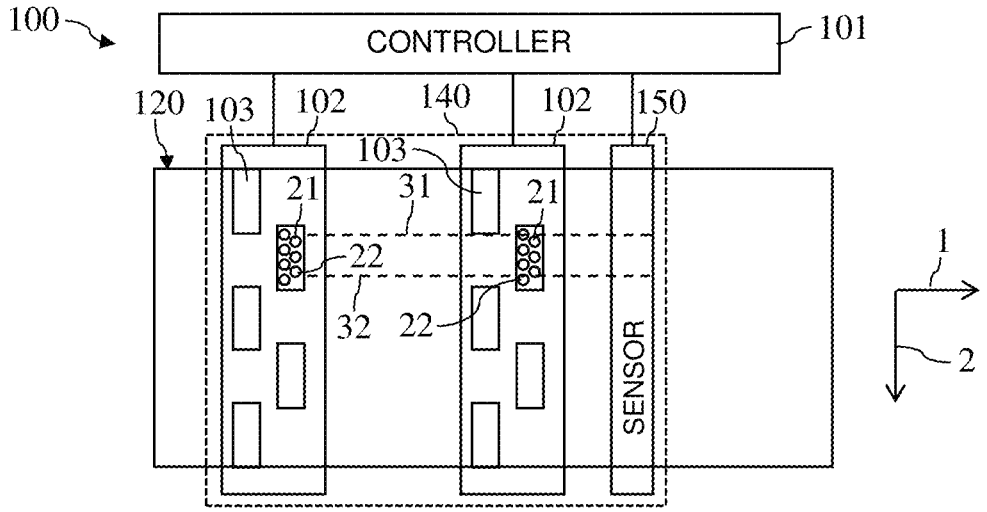

FIG. 1 illustrates an inkjet printing device according to an exemplary embodiment.

Figure 2A:
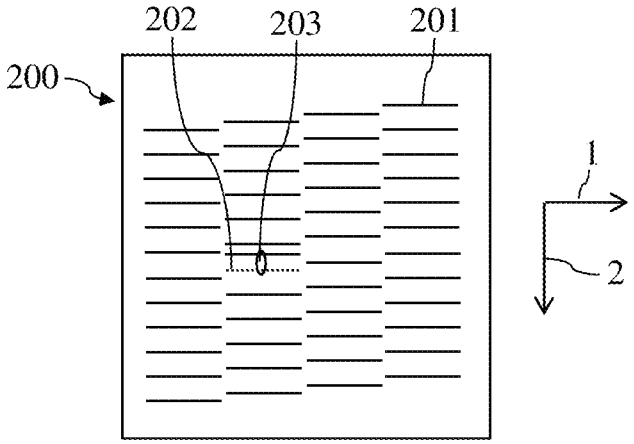

FIG. 2*a* illustrates a test print image according to an exemplary embodiment.

Figure 2B:
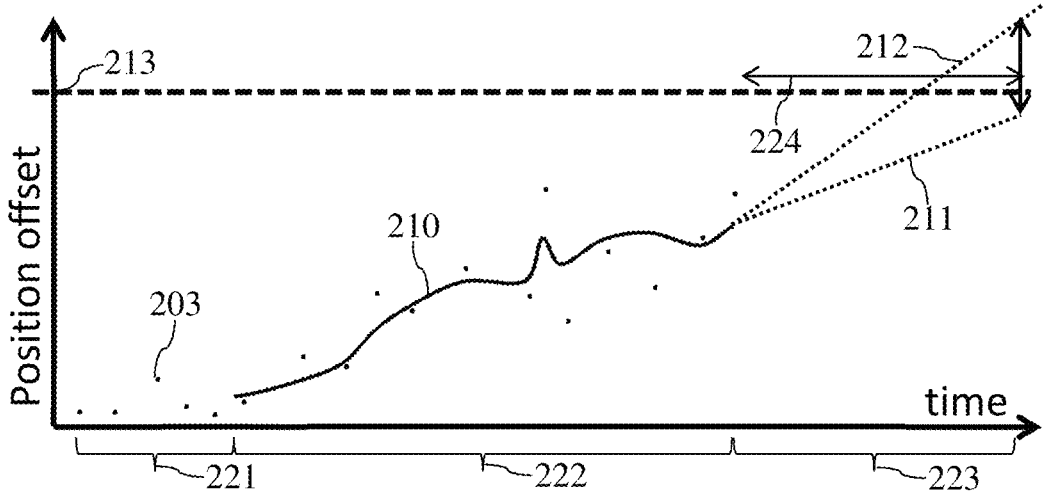

FIG. 2*b* illustrates a plot of a time curve of offset measurement values according to an exemplary embodiment.

Figure 3:
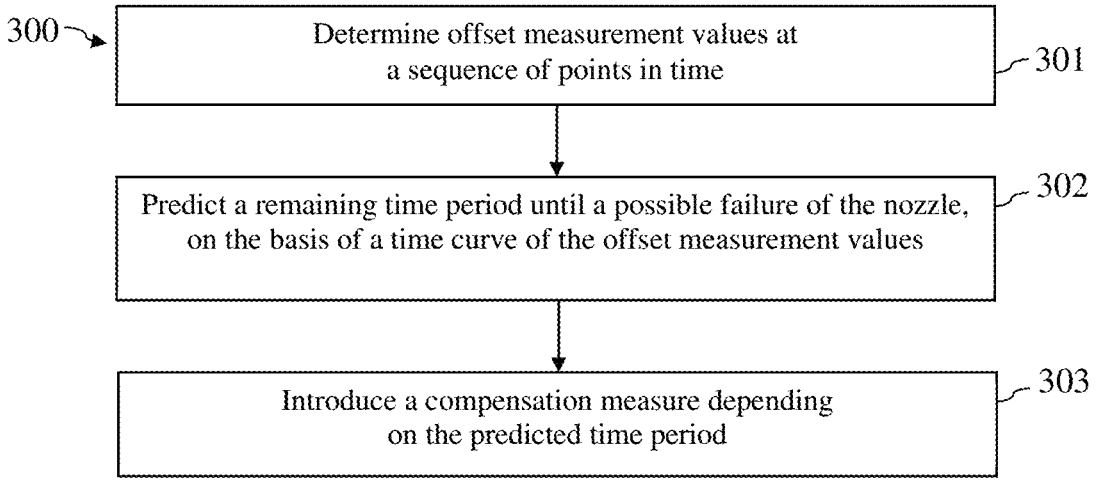

FIG. 3 is a flowchart of a method for operating a printing device according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the disclosure is to reduce the effects of a nozzle failure on the print quality of an inkjet printing device. In particular, a temporary interruption of the print quality due to a nozzle failure should thereby be efficiently and reliably prevented, at least in part or entirely.

According to one aspect of the disclosure, a controller/processing unit for an inkjet printing device is described that comprises at least one nozzle, wherein the nozzle is configured to fire or eject ink droplets onto a recording medium to print a print image. The processing unit is configured to determine a respective offset measurement value, at a sequence of successive points in time, in relation to an offset, in particular in relation to a transverse offset, on the recording medium of the ink droplet ejected from the nozzle at the respective point in time. Furthermore, the processing unit is configured to predict a remaining time period until a failure of the nozzle or until a point in time at which the time curve of the offset measurement values reaches an offset threshold, on the basis of a time curve of the offset measurement values. The processing unit is also configured to introduce at least one compensation measure depending on the predicted remaining time period, in order to at least partially compensate a failure of the nozzle or an offset of ejected ink droplets exceeding the offset threshold.

According to a further aspect of the disclosure, a method is described for operating an inkjet printing device that comprises at least one nozzle, wherein the nozzle is configured to fire ink droplets onto a recording medium in order to print a print image. The method includes the determination, for a sequence of successive points in time, of a respective offset measurement value in relation to an offset of the ink droplet ejected by the nozzle at the respective point in time on the recording medium. Furthermore, the method includes the prediction, on the basis of a time curve of the offset measurement values at the sequence of points in time, of a remaining time period until a possible failure of the nozzle or until an offset threshold is reached. The method also includes the initiation of a compensation measure depending on the predicted remaining time period.

The printing device 100 depicted in FIG. 1 is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In the depicted example, the print group 140 of the printing device 100 comprises two print bars 102, wherein each print bar 102 may be used for printing with ink of a defined color, for example black, cyan, magenta, and/or yellow, and if applicable, Magnetic Ink Character Recognition (MICR) ink. Different print bars 102 may be used for printing with respective different inks. Furthermore, the print group 140 may comprise at least one sensor 150, for example a camera, which is configured to acquire sensor data with regard to the print image printed on the recording medium 120.

A print bar 102 may comprise one or more print heads 103 that are possibly arranged side by side in a plurality of rows in order to print the dots of different columns 31, 32 of a print image onto the recording medium 120. In the example depicted in FIG. 1, a print bar 102 comprises five print heads 103, wherein each print head 103 prints the dots of one group of columns 31, 32 of a print image onto the recording medium 120. The different columns 31, 32 of a print image are arranged side by side along the transverse direction 2. Furthermore, the individual columns 31, 32 respectively travel along the transport direction 1.

In the embodiment depicted in FIG. 1, each print head 103 of the print group 140 comprises a plurality of nozzles 21, 22, wherein each nozzle 21, 22 is configured to fire or eject ink droplets onto the recording medium 120. A print head 102 of the print group 140 may, for example, comprise multiple thousands of effectively utilized nozzles 21, 22 that are arranged along multiple rows transverse to the transport direction 1 of the recording medium 120, meaning along the transverse direction 2. By means of the nozzles 21, 22 of a print head 103 of the print group 140, dots of a line of a print image may be printed on the recording medium 120 transverse to the transport direction 1, meaning along the width of the recording medium 120.

In an exemplary embodiment, the printing device 100 also includes a controller 101. The controller 1010 can be, for example, an activation hardware and/or a processor. In an exemplary embodiment, the controller 101 is configured to control the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more functions and/or operations of the controller 101. The controller 101 can include a memory that stores executable instructions and/or other data, and a processor. The processor is configured to execute the instructions to perform the functions and/or operations of the controller 101. The controller 101 may be additionally or alternatively configured to access an external memory storing instructions (or otherwise receive instructions from an external source), where these instructions are then executed by the controller 101 to perform the functions/operations of the controller 101.

As presented above, a negative effect on a nozzle 21, 22 of a print head 103 may occur in the course of the operation of the printing device 100. In particular, over time it may occur that a nozzle 21, 22 ejects ink droplets with an offset transverse to the transport direction 1, and thus a line printed by the nozzle 21, 22 along a column 31, 32 of a print image to be printed exhibits an offset transverse to the transport direction 1. The dimension of such a transverse offset may increase over time until a total failure of the nozzle 21, 22 possibly occurs.

In order to determine the state of the individual nozzles 21, 22 of the printing device 100, a test print image 200 having a test pattern may be printed as depicted by way of example in FIG. 2*a*. The test pattern may comprise individual lines 201, wherein each line 201 is respectively printed by precisely one single nozzle 21, 22. Each individual nozzle 21, 22 of the printing device 100 may thus be induced to print precisely one line 201. The test print image 200 with the test pattern may be detected by the sensor 150.

On the basis of the sensor data of the sensor 150, for every single nozzle 21, 22 a check may then be made as to whether the actual printed line 201 is offset relative to the nominal position 202 along the transverse direction 2. The magnitude of the transverse offset between the nominal position 202 and the real position of the printed line 201, as determined on the basis of the sensor data, may be provided as an offset measurement value 203. For each nozzle 21, 22 of the printing device 100, a respective offset measurement value 203 that indicates the transverse offset, possibly averaged over the number of dots of a line 201, of the ink droplets ejected by the respective nozzle 21, 22 may thus be determined by printing a test print image 200 with a test pattern.

A respective test print image 200 with a test pattern may be printed repeatedly, in particular periodically, at a sequence of points in time in order to determine offset measurement values 203 for the individual nozzles 21, 22 at the sequence of points in time. For a nozzle 21, 22, a sequence of offset measurement values 203 thus results for the corresponding sequence of points in time. FIG. 2*b* shows an example of a sequence of offset measurement values 203 for a nozzle 21, 22. The offset measurement values 203 may have been determined in an initial time interval 221 and in a subsequent measurement time interval 222.

A time curve, in particular a smoothed time curve, 210 of the offset measurement values 203 may be determined on the basis of the sequence of measured offset measurement values 203.

The time curve 210 of the offset measurement values 203 may be extrapolated based on a current point in time in order to predict a future curve 211, 212 of the offset measurement values 203. In other words, how the offset measurement values 203 will develop in an upcoming prediction time interval 223 may be predicted on the basis of the sequence of measured offset measurement values 203.

A remaining time period 224 until a total failure of the nozzle 21, 22 may then be predicted on the basis of one or more predicted curves 211, 212 of the offset measurement values 203. For this purpose, the one or more predicted curves 211, 212 may be compared with an offset threshold 213, wherein the offset threshold 213 indicates a transverse offset as of which it is to be assumed that the nozzle 21, 22 has failed, and/or indicates a transverse offset that should be compensated via a compensation measure.

In the example depicted in FIG. 2*b*, a first predicted curve 211 is determined under the assumption of a relatively slow chronological rise of the offset. Furthermore, a second predicted curve 212 is determined under the assumption of a relatively stark chronological rise of the offset. For example, the time period up to the point in time at which a weighted mean value from the first predicted curve 211 and the second predicted curve 212 reaches and/or exceeds the offset threshold 213 may be determined as a remaining time period 224 until the total failure of the nozzle 21, 22.

The failure of a nozzle 21, 22 may be at least partially compensated by one or more compensation measures so that the failure of the nozzle 21, 22 cannot be seen in a print image, or can be seen only to a reduced extent. For example, one or more nozzles 21, 22 adjacent to a failed nozzle 21, 22 may be controlled in order to eject an increased quantity of ink, and thus in order to thus at least partially compensate for the failed nozzle 21, 22.

In an exemplary embodiment, the detection of a nozzle failure and the subsequent introduction of a compensation measure requires a defined duration during which the print quality of a print image 200 is negatively affected by the failed nozzle 21, 22. Examples of components of the required duration, i.e. for the dead time, until the compensation of a nozzle failure are:

- the required time for the first-time printing of a print image 200 with a failed nozzle 21, 22, or with a nozzle 21, 22 having a high transverse offset;
- the time delay until a test print image 200 with a test pattern for detection of the nozzle failure is printed;
- the required duration for the transport of the recording medium 120 with the test pattern up to the sensor 150;
- the required duration for the detection of sensor data with regard to the test pattern;
- the required duration for the evaluation of the sensor data with regard to the test pattern;
- the required duration for the transmission of the results of the evaluation to the controller of the printing device 100;
- the required duration for the application of the compensation algorithm, or for the realization of the compensation measure;
- the required duration for the printing of the page buffer of the printing device 100 until the first compensated page is reached; and/or
- the required duration for the printing of the first page with active compensation.

Overall, a defined minimum required duration thus results, which is a dead time between a decision point in time at which it is decided that a compensation measure should be introduced and the effective point in time as of which the compensation measure effectively has a compensating effect on the print quality of the printing device 100.

In an exemplary embodiment, the controller 101 of the printing device 100 is configured to compare the predicted duration 224 until a failure of a nozzle 21, 22 with the minimum required duration, meaning with the dead time, for the introduction of a compensation measure. Furthermore, in an exemplary embodiment, the controller 101 is configured to decide that a compensation measure should be introduced as soon as it is detected that the predicted duration 224 until a failure of a nozzle 21, 22 is still sufficient, for example under consideration of a temporal safety buffer, in order to introduce the compensation measure before the failure of the nozzle 21, 22 affects the print quality. A temporary decrease in the print quality of the printing device 100 may thus be reliably avoided via such an early and/or prompt introduction of a compensation measure. Furthermore, it may thus be prevented that a compensation measure is introduced too early and that the print quality is negatively affected in advance of the failure of the nozzle 21, 22.

The position offset measurement values 203 of a line 201 may thus be determined from the line pattern of a test print image 200 and be considered at multiple successive points in time over a plurality of measurements. Test patterns may thereby possibly be printed and measurements implemented relatively often, for instance on every fourth page. Via the implemented measurements of the position offset 203, a running averaging may take place, for example by means of a sliding window. The averaging may thereby begin after the expiration of the initial time interval 22 on the basis of the measurement values 203 detected in the initial time interval 221, and then be continued within the measurement time interval 222. For example, the averaging may take place over 10 respective measurement values 203. A smoothed or averaged time curve 210 of the measurement values 203 may thus be determined. Individual outliers are eliminated by the averaging and the measurements are stabilized. It may thus be reliably prevented that individual outliers lead to the introduction of compensation measures.

The time curve 210 of the position offset measurement values 203 may be tracked, and the further, future curve 211, 212 may be preordained using a quality function. This prediction of the offset measurement values 203 is shown as a dotted line in the prediction interval 223 in FIG. 2*b*. It may be checked when the future curve 211, 212 will exceed the threshold 213, for example of 21 μm, and the remaining time 224 until this point in time may be calculated. If the remaining duration 224 is less than the required duration, meaning the dead time, for the compensation loop, the compensation may be introduced immediately. With this it is achieved that the compensation is applied as quickly as possible after the occurrence of the no longer acceptable position offset 213.

A controller 101 for an inkjet printing device 100 is thus described, wherein the printing device 100 comprises at least one nozzle 21, 22. In particular, the printing device 100 may comprise a plurality of nozzles 21, 22 that may be arranged in one or more print heads 103 and/or in one or more print bars 102, for example as presented in conjunction with FIG. 1. The recording medium 120 to be printed to may thereby be directed past the one or more stationary nozzles 21, 22. A nozzle 21, 22 of the printing device 100 may be configured to print the dots of precisely one line 201 or column 31, 32 of a print image onto the recording medium 120. A one-to-one relationship may thereby exist between a line 201 or column 31, 32 of a print image and a nozzle 21, 22 of the printing device 100. A nozzle 21, 22 of the printing device 100 may be configured to fire or eject ink droplets onto the recording medium 120 to print a print image. One or more respective ink droplets may thereby be ejected for each dot to be printed.

In an exemplary embodiment, the controller 101 is configured to determine, at or for a sequence of successive points in time, a respective offset measurement value 203 with regard to the offset of the ink droplet ejected onto the recording medium 120 at the respective point in time by the nozzle 21, 22. For example, a respective offset measurement value 203 may be periodically determined and possibly stored. A time sequence of offset measurement values 203 may thus be determined.

In an exemplary embodiment, the controller 101 is configured to induce the nozzle 21, 22 to print a test print image 200 onto the recording medium 120 at a point in time of the sequence of points in time. The test print image 200 may thereby comprise a line 201 having a plurality of dots, wherein the dots have respectively been printed by the considered nozzle 21, 22.

Furthermore, in an exemplary embodiment, the controller 101 is configured to induce a sensor 150 of the printing device 100, for example a camera, to acquire sensor data with regard to the test print image 200. The offset measurement value 203 at the respective point in time may then be precisely determined on the basis of the sensor data. In particular, the controller 101 may be configured to determine the real position of the line 201 on the recording medium 120 on the basis of the sensor data. Furthermore, the controller 101 may be configured to compare the real position with a nominal position 202 of the line 201 in order to determine the offset measurement value 203, in particular as a distance between the real position and the nominal position 202. The offset measurement values 203 may thus be precisely determined.

The sequence of points in time may include past points in time. In other words, it may be determined how the offset measurement values 203 developed in the past. In yet more other words, a time curve 210 of the offset measurement values 203 in the past may be determined.

In an exemplary embodiment, the controller 101 is configured to predict, on the basis of the time curve 210 of the offset measurement values 203 at the sequence of points in time, an upcoming, remaining time period 224 until a possible failure of the nozzle 21, 22 or until an offset threshold 213 is reached. In particular, a remaining time period 224 in the future may be predicted on the basis of the time curve 210 of the offset measurement values 203 of past points in time. For example, the controller 101 may be configured to predict the remaining time period 224 at a decision point in time. The time curve 210 of offset measurement points 203 may be at least partially or entirely before the decision point in time. On the other hand, the predicted remaining time period 224 may extend to points in time after the decision point in time.

In an exemplary embodiment, the controller 101 is configured to extrapolate the time curve 210 of the offset measurement values 203 in an upcoming prediction time interval 223 in order to predict the remaining time period 224 until a possible failure 21, 22 or until the offset threshold 213 is reached. One or more extrapolation rules may thereby be used. The extrapolated curve 211, 212 of the offset measurement values 203 may then be compared with the offset threshold 213 in order to determine the remaining time period 224. In particular, the remaining time period as of the decision point in time may be determined, up to the point in time at which the extrapolated curve 211, 212 of the offset measurement values 203 reaches the offset threshold 213. The remaining time period 224 may thus be determined or predicted especially precisely.

In an exemplary embodiment, the controller 101 is configured to smooth the sequence of offset measurement values 203 at the sequence of points in time by means of a lowpass filter and/or by calculating a sliding average, in order to determine the time curve 210 of the offset measurement values 203. The smoothed time curve 210 of the offset measurement values 203 may then be used to particularly precisely determine or predict the remaining time period 224.

In an exemplary embodiment, the prediction of the remaining time period 224 may be implemented using an automatically trained artificial neural network. The neural network may thereby assume the time curve 210 of the offset measurement values 203 as an input value. Furthermore, the neural network may be designed to provide the remaining time period 224 as an output value. The neural network may have been trained on the basis of training data that include a plurality of training data sets. The training data sets may thereby be determined on the basis of measurements at individual nozzles 21, 22 of a printing device 100. In an exemplary embodiment, a training data set may be a tuple consisting of a measured time curve 210 of offset measurement values 203 and a measured remaining time period 224 for the measured time curve 210 of offset measurement values 203. The remaining time period 224 may be particularly precisely predicted via the use of a trained neural network.

In an exemplary embodiment, the controller 101 is configured to introduced a compensation measure, depending on the predicted remaining time period 224, in order to at least partially compensate a failure of the nozzle 21, 22 or an offset of ejected ink droplets exceeding the offset threshold 213. The compensation measure may thereby be introduced at the decision time period. In other words, at the decision time period it may be decided whether the compensation measure is introduced or not. The compensation measure may thus be introduced even before a nozzle failure has occurred and/or even before too large an offset of the ink droplets ejected by the nozzle 21, 22 takes place. An interruption of the print quality of the printing device 100 may thus be reliably avoided.

The compensation measure may be intended to at least partially compensate for a failure of the nozzle 21, 22 and/or too large an offset of the dots printed by said nozzle 21, 22, such that the effects of the impairment of the nozzle 21, 22 are less or not at all visible in a print image. Within the scope of the compensation measure, one or more adjacent nozzles 21, 22 of the negatively affected nozzle 21, 22 may be induced to eject more or less ink, deviating from a state without compensation measure.

The printing device 100 may be designed such that, as of the decision point in time at which the compensation measure is introduced, said compensation measure takes effect on a print image printed by the printing device 100 only after expiration of a dead time. The dead time may include one or more of the time components listed above.

In an exemplary embodiment, the controller 101 is configured to also introduce the compensation measure depending on the dead time. For example, the controller 101 may be configured to take the dead time into account in the decision as to whether a compensation measure should be introduced or not at the decision point in time. In an exemplary embodiment, the controller 101 may be configured to compare the predicted remaining time period 224 with the dead time. Depending on the comparison, a decision may reliably be made as to whether the compensation measure is introduced or not at the decision point in time.

In an exemplary embodiment, the controller 101 is configured to introduce the compensation measure at the decision point in time if or as soon as the predicted remaining time period 224 exceeds the dead time by a buffer time period or by less than the buffer time period. On the other hand, the controller 101 may be configured to not introduce the compensation measure at the decision point in time if the predicted remaining time period 224 exceeds the dead time by more than the buffer time period. The buffer time period may be relatively small, for example zero. This may thus have the effect that a compensation measure is introduced as late as possible in order to avoid the print quality being negatively affected before a nozzle failure, but is introduced sufficiently early in order to avoid the print quality being temporarily interrupted as a result of a nozzle failure.

In an exemplary embodiment, the controller 101 is configured to determine a respective current offset measurement value 203 at successive decision points in time in order to update the curve 210 of the offset measurement values 203, and to predict a respective updated remaining time period 224 based on the respective updated curve 210 of the offset measurement values 203. Whether the compensation measure is introduced or not may then be decided at the respective decision point in time on the basis of the respective updated remaining time period 224. A high print quality may thus be steadily provided.

As has already been presented above, the printing device 100 typically comprises a plurality of nozzles 21, 22. The controller 101 may be configured to determine offset measurement values 203 for each of the plurality of nozzles 21, 22; to predict a remaining time period 224 up to a possible failure of the respective nozzle 21, 22, or up to reaching the offset threshold 213; and to introduce a compensation measure for the respective nozzle 21, 22 depending on the predicted remaining time period 224. A monitoring and prediction of the offset situation of every single nozzle 21, 22 of the printing device 100 may thus take place. The print quality of the printing device 100 may thus be further increased.

A controller 101, according to an exemplary embodiment, for an inkjet printing device 100 is configured to predict a remaining time period 224 up to a failure of the nozzle 21, 22 on the basis of the time curve 210 of offset measurement values 203 with regard to the offset, in particular with regard to the transverse offset, of the ink droplets ejected by said nozzle 21, 22. On the basis of the prediction, a compensation measure may be promptly introduced before the actual failure of the nozzle 21, 22 in order to have the effect that the compensation measure takes effect at the latest or preferably precise at the point in time of the actual or predicted failure of the nozzle 21, 22, and thus an interruption of the print quality may be reliably avoided.

In an aspect of the disclosure, an inkjet printing device 100 includes the controller 101 according to one or more exemplary embodiments.

FIG. 3 shows a workflow diagram of an example of a method 300 for operating an inkjet printing device 100 that comprises at least one nozzle 21, 22, wherein the nozzle 21, 22 is configured to eject ink droplets onto a recording medium 120 in order to print a print image. The method 300 may be executed by a controller 101 of the printing device 100.

In an exemplary embodiment, the method 300 includes the determination 301, for a sequence of successive points in time, of a respective offset measurement value 203 with regard to an offset of the ink droplet ejected onto the recording medium 12 by the nozzle 21, 22 at the respective point in time. Furthermore, the method 300 includes the prediction 302, on the basis of a time curve 210 of the offset measurement values 203 at the sequence of points in time, of a remaining time period 224 until a possible failure of the nozzle 21, 22, and/or until a point in time at which the time curve 210 reaches or exceeds an offset measurement value 213. The method 300 also includes the initiation 303 of a compensation measure depending on the predicted remaining time period 224. The compensation measure may thereby be intended to at least partially compensate for a failure of the nozzle 21, 22 or an offset of ejected ink droplets that exceeds the offset threshold 213.

A stabilization of the failure compensation of an inkjet printing device 100 may be produced via the measures described in this document. Furthermore, nozzle failures that lead to visible negative effects on the print quality may be reliably prevented. The occurring spoilage of a printing device 100 may also be reduced.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
2 transverse direction
21, 22 nozzle
31, 32 column
100 printing device
101 controller or processing unit
102 print bar
103 print head
120 recording medium
140 print group
150 sensor
200 print image (test pattern)
201 printed line
202 nominal position of a line
203 offset measurement value
210 smoothed time curve of the offset measurement values
211, 212 predicted curve of the offset measurement values
213 offset threshold
221 initial time interval
222 measurement time interval
223 prediction time interval
224 remaining time period until a nozzle failure
300 method for compensating a nozzle failure
301-304 method steps

The invention claimed is:

1. A controller for an inkjet printing device including at least one nozzle configured to fire ink droplets onto a recording medium to print a print image, the controller being configured to:

determine, based on sensor data, a real position of a line of a test print image;

compare the real position with a nominal position of the line to determine, at a sequence of successive points in time, a respective offset measurement value corresponding to an offset of an ink droplet ejected onto the recording medium by the at least one nozzle at the respective point in time;

predict, based on a time curve of the offset measurement values at the sequence of points in time, a remaining time period until: a failure of the nozzle, or a point in time at which the time curve of the offset measurement values reaches an offset threshold; and introduce a compensation measure, based on the predicted remaining time period, to at least partially compensate for an offset of ejected ink droplets exceeding the offset threshold.

2. The controller according to claim 1, wherein:

the printing device is configured such that, as of a point in time at which the compensation measure is introduced, the compensation measure takes effect only after expiration of a dead time on a print image printed by the printing device; and the controller is further configured to introduce the compensation measure depending on the dead time.

3. The controller according to claim 2, wherein the controller is further configured to:

compare the predicted remaining time period with the dead time; and selectively introduce the compensation measure based on the comparison.

4. The controller according to claim 3, wherein the controller is configured to:

introduce the compensation measure in response to the predicted remaining time period exceeding the dead time by a buffer time period or by less than the buffer time period; and not introduce the compensation measure in response to the predicted remaining time period exceeding the dead time by more than the buffer time period.

5. The controller according to claim 2, wherein the controller is configured to:

introduce the compensation measure in response to the predicted remaining time period exceeding the dead time by a buffer time period or by less than the buffer time period; and not introduce the compensation measure in response to the predicted remaining time period exceeding the dead time by more than the buffer time period.

6. The controller according to claim 1, wherein the controller is configured to extrapolate the time curve of the offset measurement values in an upcoming prediction time interval to predict the remaining time period until: a failure of the nozzle, or a point in time at which the time curve of the offset measurement values reaches the offset threshold.

7. The controller according to claim 1, wherein the controller is configured to smooth the sequence of offset measurement values at the sequence of points in time by: lowpass filtering and/or calculating a sliding average, to determine the time curve of the offset measurement values.

8. The controller according to claim 1, wherein the controller is configured to:

induce the nozzle to print a toner image onto the recording medium at a point in time of the sequence of points in time;

induce a sensor of the printing device to acquire the sensor data with regard to the test print image; and determine the offset measurement value at the point in time based on the sensor data.

9. The controller according to claim 1, wherein:

the printing device comprises a plurality of nozzles; and the controller is configured to, for each of the plurality of nozzles:

determine the offset measurement values;

predict the remaining time period until a possible failure of the respective nozzle or until the offset threshold is reached; and introduce the compensation measure for the respective nozzle based on the predicted remaining time period.

10. The controller according to claim 1, wherein the line of the test print image includes a plurality of dots.

11. A method for operating an inkjet printing device having at least one nozzle configured to fire ink droplets onto a recording medium to print a print image, the method comprising:

determining, based on sensor data, a real position of a line of a test print image;

comparing the real position with a nominal position of the line to determining, for a sequence of successive points in time, a respective offset measurement value corresponding to an offset of the ink droplet ejected onto the recording medium by the at least one nozzle at the respective point in time;

predicting, based on a time curve of the offset measurement values at the sequence of points in time, a remaining time period until: a failure of the nozzle, or a point in time at which the time curve of the offset measurement values reaches an offset threshold; and initiating a compensation measure, based on the predicted remaining time period, to at least partially compensate for an offset of ejected ink droplets exceeding the offset threshold.

12. A non-transitory computer-readable storage medium with an executable program stored thereon, wherein, when executed, the program instructs a processor to perform the method of claim 11.

13. A method according to claim 11, wherein the line of the test print image includes a plurality of dots.

14. A controller for an inkjet printing device including at least one nozzle configured to fire ink droplets onto a recording medium to print a print image, the controller being configured to:

determine, at a sequence of successive points in time, a respective offset measurement value corresponding to an offset of an ink droplet ejected onto the recording medium by the at least one nozzle at the respective point in time;

predict, based on a time curve of the offset measurement values at the sequence of points in time, a remaining time period until: a failure of the nozzle, or a point in time at which the time curve of the offset measurement values reaches an offset threshold; and introduce a compensation measure, based on the predicted remaining time period, to at least partially compensate for: a failure of the at least one nozzle or an offset of ejected ink droplets exceeding the offset threshold, wherein:

the printing device is configured such that, as of a point in time at which the compensation measure is introduced, the compensation measure takes effect only after expiration of a dead time on a print image printed by the printing device; and the controller is further configured to introduce the compensation measure depending on the dead time.

15. A method for operating an inkjet printing device having at least one nozzle configured to fire ink droplets onto a recording medium to print a print image, the method comprising:

determining, for a sequence of successive points in time, a respective offset measurement value corresponding to an offset of the ink droplet ejected onto the recording medium by the at least one nozzle at the respective point in time;

predicting, based on a time curve of the offset measurement values at the sequence of points in time, a remaining time period until: a failure of the nozzle, or a point in time at which the time curve of the offset measurement values reaches an offset threshold; and initiating a compensation measure, based on the predicted remaining time period, to at least partially compensate for: a failure of the at least one nozzle or an offset of ejected ink droplets exceeding the offset values, wherein:

the printing device is configured such that, as of a point in time at which the compensation measure is introduced, the compensation measure takes effect only after expiration of a dead time on a print image printed by the printing device; and the compensation measure is introduced depending on the dead time.

* * * * *